US007700864B1

(12) United States Patent
Sikra

(10) Patent No.: US 7,700,864 B1
(45) **Date of Patent: *Apr. 20, 2010**

(54) LOCKABLE THROW-OFF FOR SNARE DRUM

(75) Inventor: Richard A. Sikra, Thousand Oaks, CA (US)

(73) Assignee: Drum Workshop, Inc., Oxnard, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/319,983

(22) Filed: Jan. 13, 2009

(51) Int. Cl.
*G10D 13/02* (2006.01)

(52) U.S. Cl. ..... 84/413; 84/411 R

(58) Field of Classification Search ..... 84/411 R, 84/413–415

See application file for complete search history.

(56) References Cited

U.S. PATENT DOCUMENTS 5,616,875 A * 4/1997 Lombardi ..... 84/415

* cited by examiner

*Primary Examiner*—Kimberly R Lockett
(74) *Attorney, Agent, or Firm*—William W. Haefliger

(57) ABSTRACT

An adjusting throw-off device for use on a drum having a side wall and a head, comprising a support body attachable to side wall of the drum, a hand manipulable lever having pivotal attachment to the body, a tensioning member operatively connectible to a strap that tensions release strands extending adjacent the drum head, the member having operative guided relation with the body in tilting and in endwise extension and retraction modes, and operative connection with the lever to tension the strap and strands to captivate the lever when the lever is swung toward the support body, and to de-tension the strap and strands when the lever is swung away from the support body.

12 Claims, 6 Drawing Sheets

LOCKABLE THROW-OFF FOR SNARE DRUM

BACKGROUND OF THE INVENTION

This invention relates generally to drumming apparatus, and more particularly to improvements in respect of tensioning of multiple strands that co-act with a drum head to produce desired acoustic effects.

U.S. Pat. No. 5,616,875 discloses apparatus of this general character. There is need for improvements in lever controlled tensioning and de-tensioning of the multiple strands as well as enabling lever captivation in strand tensioned condition, as are disclosed herein.

SUMMARY OF THE INVENTION

It is a major object of the invention to provide improved apparatus as referred to, and which comprises:

a) a support body attachable to side wall of the drum, b) a hand manipulable lever having pivotal attachment to the body, c) a tensioning member operatively connectible to a strap that tensions release strands extending adjacent the drum head, d) said member having operative guided relation with said body in tilting and in endwise extension and retraction modes, and operative connection with the lever to tension said strap and strands to captivate the lever when the lever is swung toward the support body, and to de-tension the strap and strands when the lever is swung away from the support body.

Another object of the invention is to provide the tensioning member with adjustability to adjust strap and strand tension as the member is adjustably tilted as the lever wings over center. In this regard, the member typically has a first portion guided for endwise sliding movement by a guide on said body, and a second portion link connected to the lever and in spaced relation to said pivotal attachment of the lever to said body.

A further object contributing to ease of, and assured functioning, is to provide both the tensioning member and the lever to have common pivotal connection with the support body, to tilt independently about the same axis. In this regard, the tensioning member typically has an elongated guide slot that allows the tensioning member to move endwise relative to the pivotal connection. Also, the lever is typically pivotally connected to said tensioning member at a location that is endwise spaced from said common pivotal connection, so as to progressively captivate the lever in response to over-center camming action of elements in response to lever swinging into retracted position.

Another object is to provide the tensioning member to have a threaded shank portion, a nut located at a side of the lever, the nut rotatable to adjust the endwise positioning of the tensioning member.

Yet another object is to provide the support body with a cavity into which said tensioning member is receivable toward over-center camming structure as the lever swings toward the support body.

These and other objects and advantages of the invention, as well as the details of an illustrative embodiment, will be more fully understood from the following specification and drawings, in which:

DRAWING DESCRIPTION

DETAILED DESCRIPTION

Figure 3:
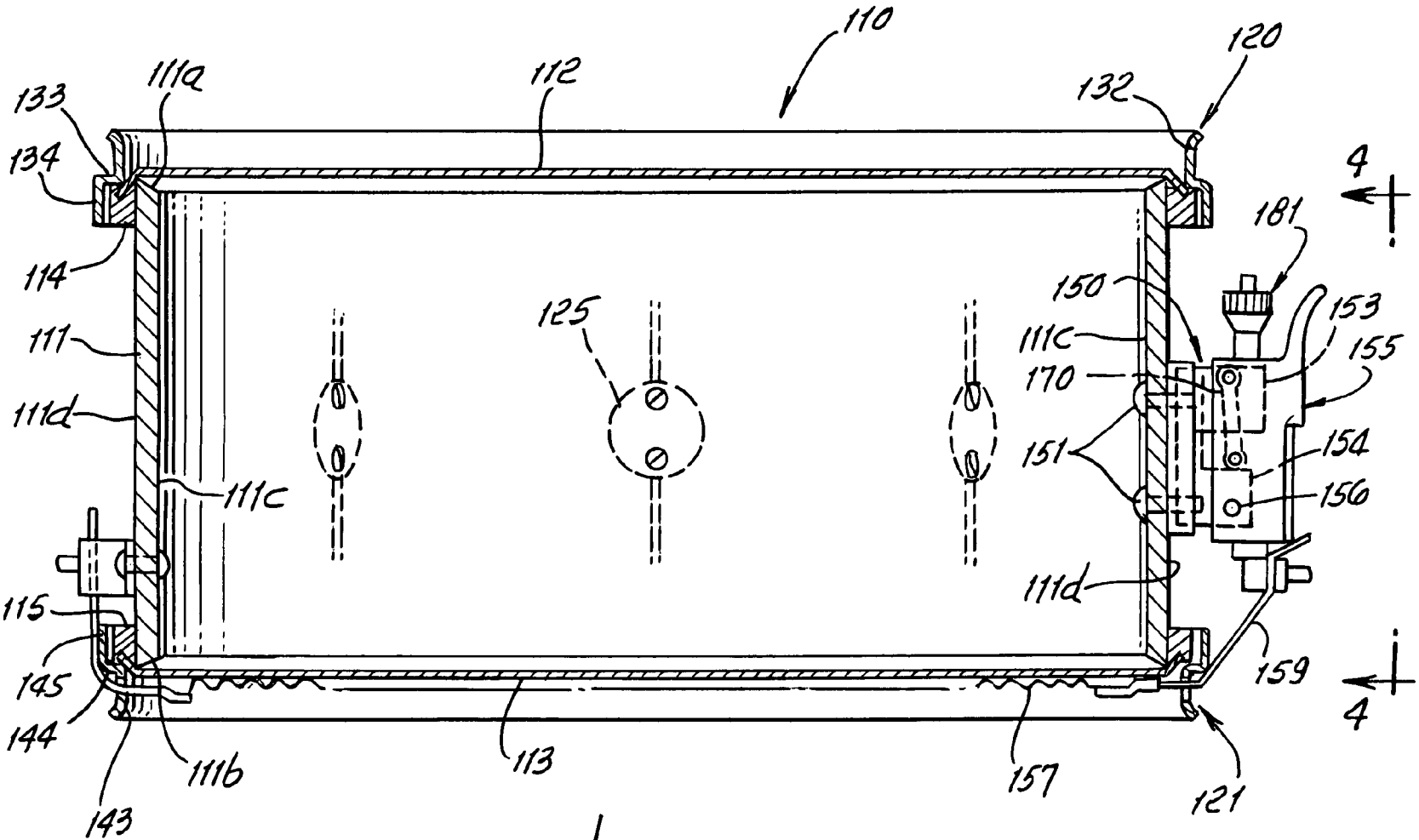
FIG. 3 is an enlarged vertical section taken on lines 3-3 of FIG. 1.
Figure 4:
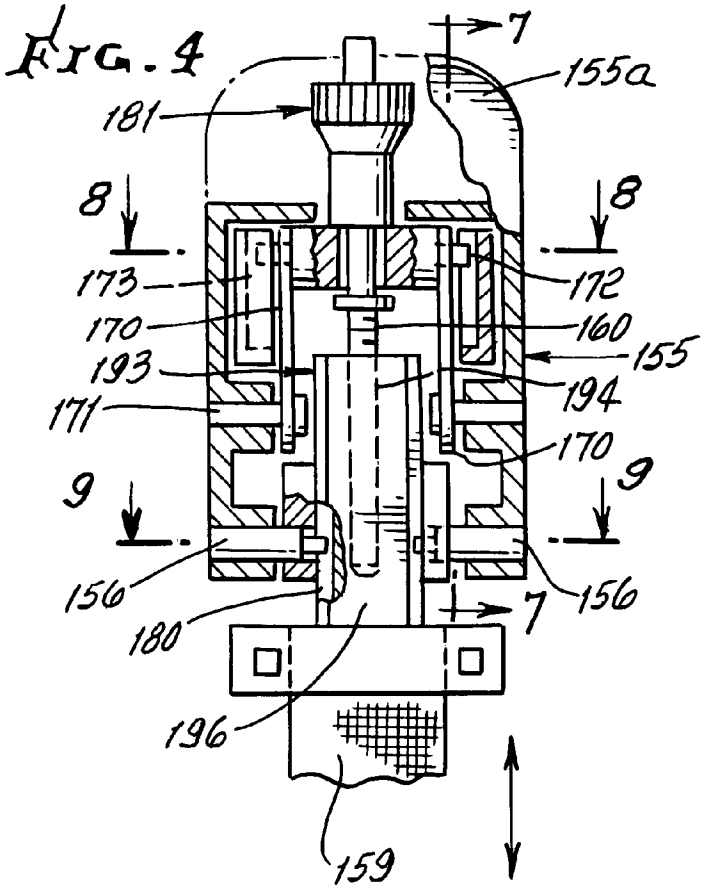
FIG. 4 is an enlarged side elevation taken on lines 4-4 of FIG. 3.

In the drawings, a preferred drum 10 has a shell 111 that comprises a cylindrical section, and oppositely positioned annular and inwardly angled ends 111*a* and 111*b* appear in FIG. 3. The shell typically consists of wood, and has inner and outer cylindrical walls 111*c* and 111*d*.

Drum heads 112 and 113 extend over the shell ends 111*a* and 111*b*, and are retained in taut condition. They may consist of thin sheets of plastic or other material. Annular metallic flanges 114 and 115 are typically attached to the respective heads 112 and 113 for retaining them in taut condition. Flanges 114 and 115 extend about opposite end extents of the shell, as seen in FIG. 3.

Retention flange structure 120 is provided in association with one end 111*a* of the shell, and retention flange structure 121 in association with the opposite end of the shell.

Figure 1:
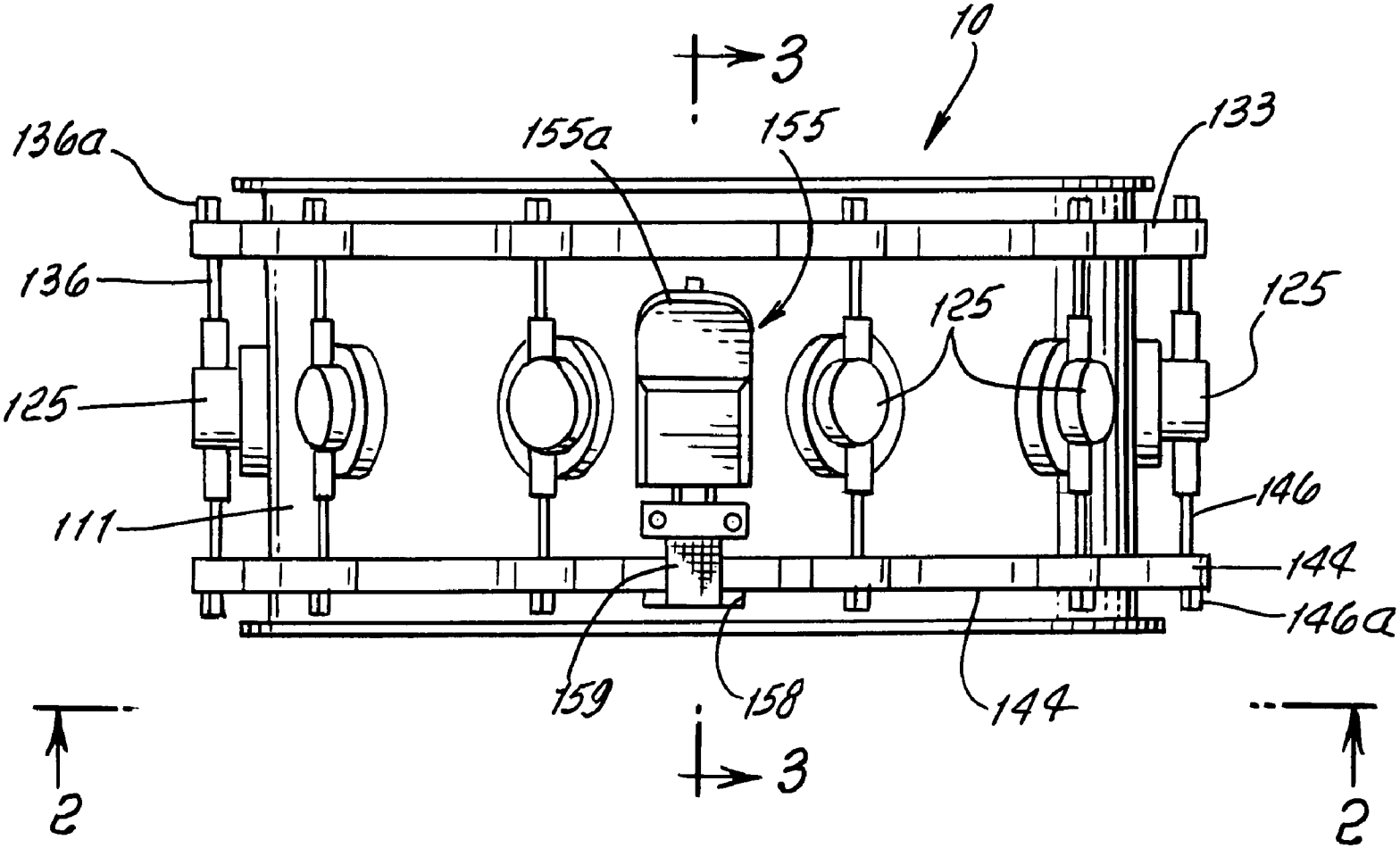
FIG. 1 is a side elevation of a drum incorporating the invention.
Figure 2:
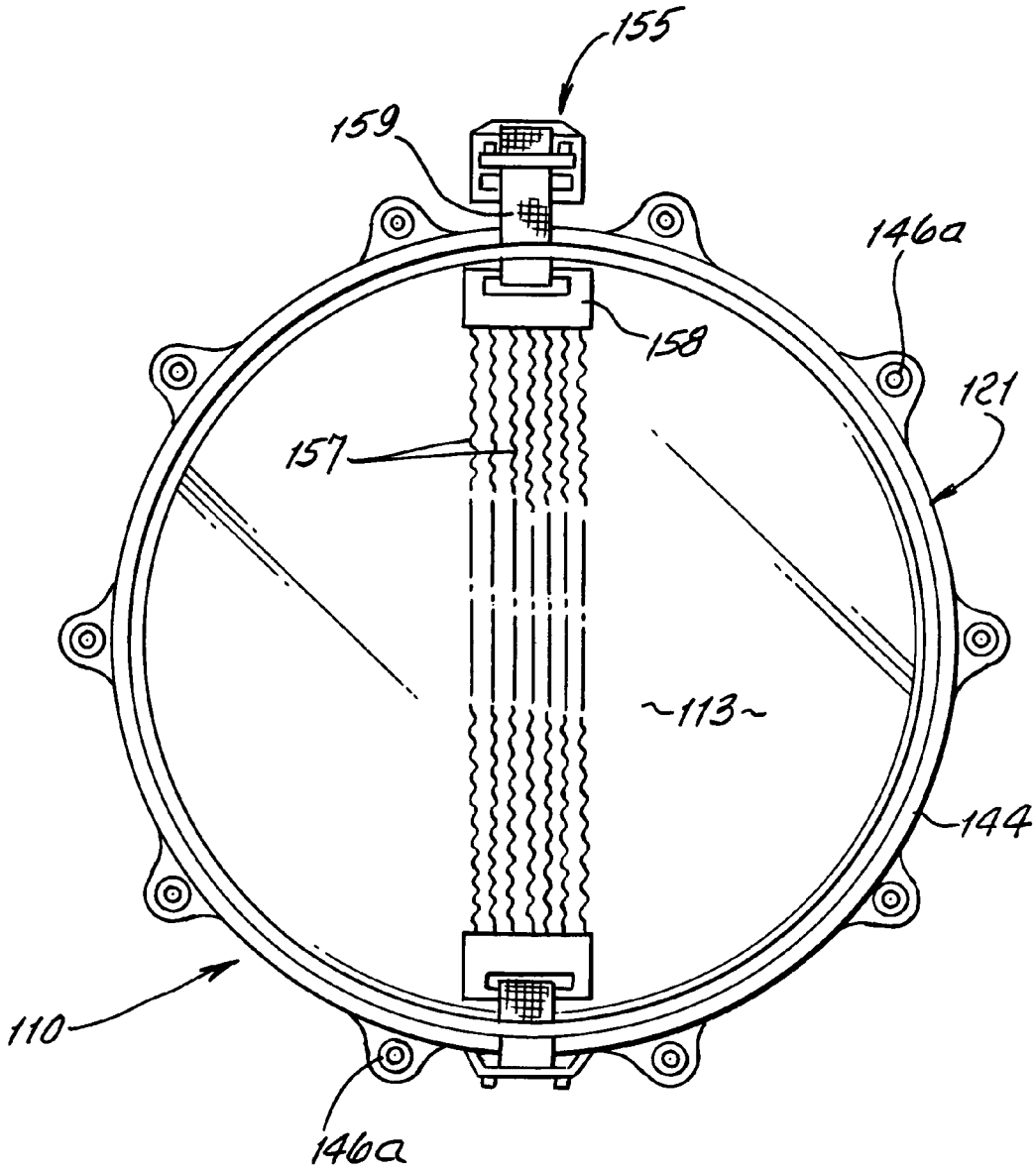
FIG. 2 is a plan view taken on lines 2-2 of FIG. 1.

Upper flange structure 120 has an upwardly extending annular rim portion 132 extending above the level of drum head 112, a medial annular portion 133 extending radially outwardly below the end of 132 for transmitting head tightening loading to flange 114, and a lower annularly extending portion 134 extending downwardly from the outer extent of 133. A tightening adjustment fastener rod 136 extends downwardly through 133 and has external threads that interfit upper internal threads in holder or stud 125. Fastener head 136*a* bears on upper surface of 133, as seen in FIG. 1. The lower surface of 133 exerts downward loading onto retention ring or flange 114 to which drum head 112 is attached for adjusting its tautness, by drawing the head over 111*a*.

Lower flange structure 121 has a downwardly extending rim portion 143 extending below the level of head 113, a medial annular portion 144 extending radially outwardly above the level of 143 for transmitting head tightening loading, and an upper annularly extending portion 145 extending upwardly from outer extent of 144. A tightening adjusting fastener rod 146 extends upwardly through 144 and has external threads that interfit rotatably lower internal threads in holder or stud 125. See FIGS. 1 and 3. Fastener head 146*a* bears on the lower surface of 144. The upper surface of 144 exerts upward loading onto lower retention ring or flange 115, to which drum head 113 is attached for adjusting its tautness, i.e. over bevel 111*b*. Fasteners connect 125 to 111. Accordingly, the drum heads are individually adjustable, and acoustic benefits are enabled, while the drum heads are held stretched over metallic edges, with acoustic benefits.

Figure 5:
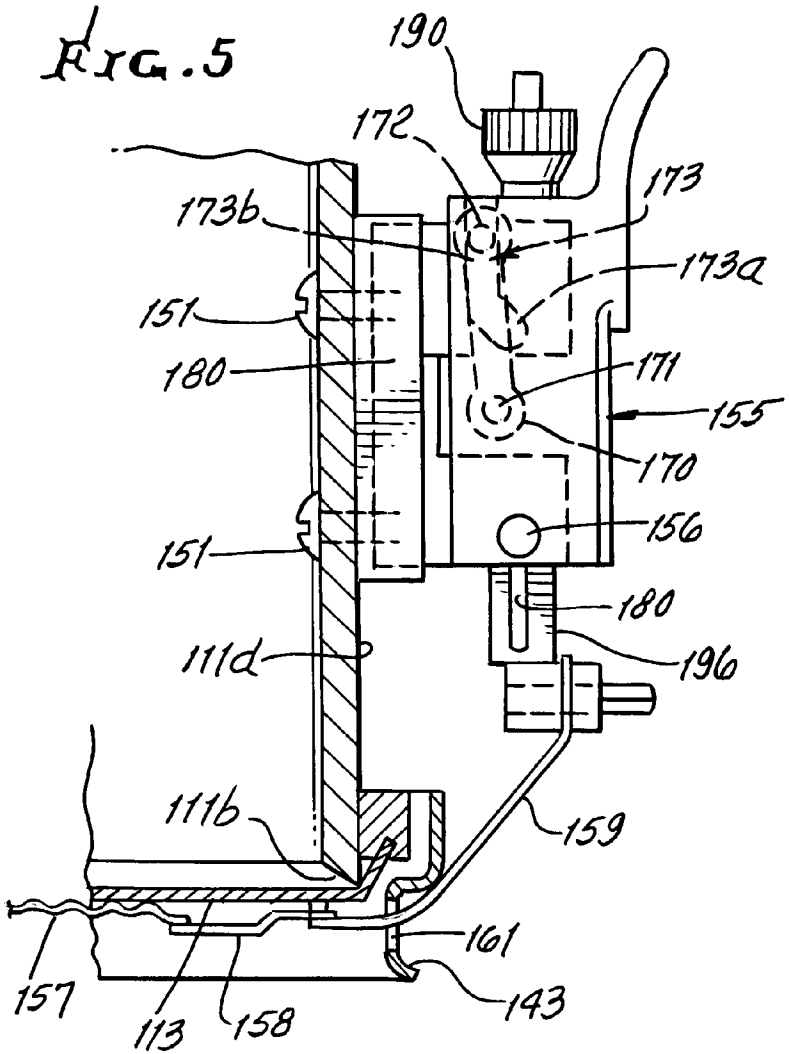
FIG. 5 is an enlarged side view of the device as is also seen in FIG. 3; the lever being in closed position.
Figure 6:
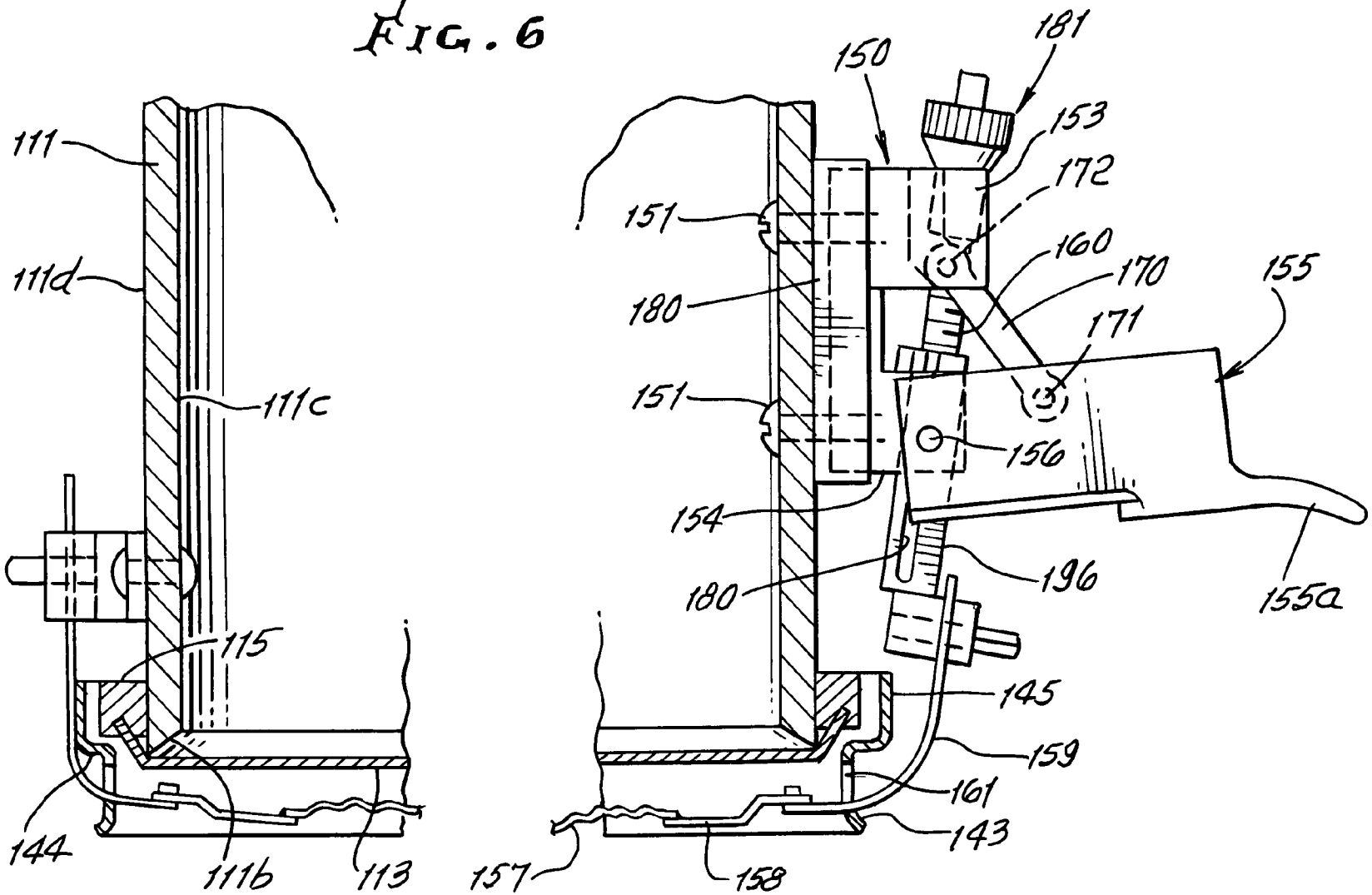
FIG. 6 is a view similar to FIG. 5, showing the lever in open position.
Figure 7:
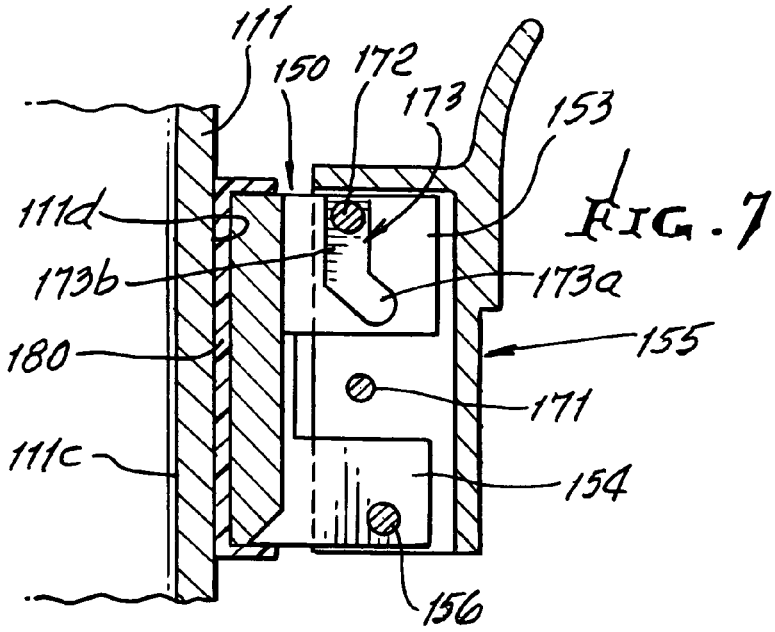
FIG. 7 is a section showing a cam guiding path for the link connection to the lever.
Figure 8:
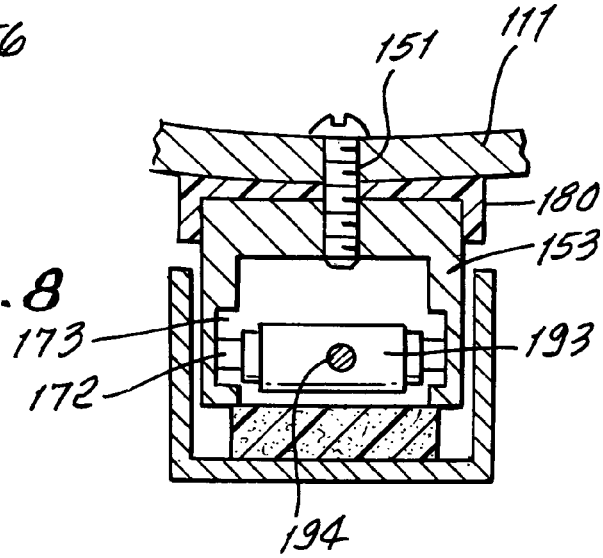
FIG. 8 is a section taken on lines 8-8 of FIG. 4.

In FIG. 3, a support body 150 is shown as attached as by fasteners 151 to the outer side 111*d* of drum wall 111, above the bottom level 111*b* of that wall. A pad 180 positions the body as seen in FIG. 7. Body 150 projects radially outwardly and has upper and lower legs 153 and 154, vertically spaced apart. A lever 155 has pivotal attachment to the body as for example by means of pivot pins 156 extending from lower sections 155*a* and 155*b* into sections 154*a* and 154*b* of body lower leg. See FIG. 9. The lever is thereby enabled to swing between release position seen in FIG. 6 in which metallic strands 157 proximate but spaced from the lower head are de-tensioned, and activated position as seen in FIG. 5, in which strands 157 are tensioned and adjacent the lower head for acoustically striking the head 113 upon drum stick beating of the upper drum head 112. In FIG. 6 the lever is swung away from the drum side wall, whereas in FIG. 5 the lever is swung toward the drum wall, and captivated in position by over-center camming action, as will be described.

The ends of the strands 157 closest to the lever are connected at 158 to a strap 159 operatively connected to the lever. A tensioning member 160 is connected by releasable clamp 170 to the upper end of the strap 159, and the lower end of that strap extends through an opening 161 in the drum lower rim portion 143. Member 160 has operative connection with the lever to tension the strap and strands, when the lever is swung toward the support body, and to de-tension the strap and strands when the lever is swung away form the support body. Note lever handle 155*a* that is manually manipulable. In addition, the tensioning member 160 is itself swung inwardly as the lever is swung inwardly, by virtue of operative connection to the lever, to accommodate dogleg, over-center camming of the upper end of the tensioning member so as to lock it proximate the body 150 thereby to captivate the lever in FIG. 5 retracted position, preventing inadvertent release of the lever as the drum is repeatedly impacted by drum sticks and bodily swung back and forth by the drummer.

Figure 9:
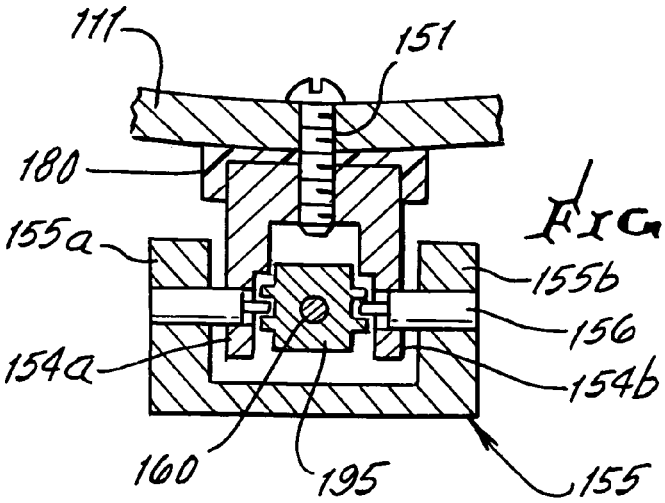
FIG. 9 is a section taken on lines 9-9 of FIG. 4.

It will be noted that both the tensioning member 160 and the lever have common pivot connection at 156 to the support body 150. See for example FIG. 9 and FIG. 7 showing such connection to lower legs 154, with body 160 confined between legs 154, and lever flanges 155*a* and 155*b* outside those legs. A link or links 170 are pivotally connected to the lever at 171, and to the tensioning member 160, as at location or locations 172 that are endwise spaced from the common pivotal connection 156.

A dogleg, cam guide or guides is or are provided at 173 in the upper legs 153 of the support body for the pivotal connection or connections 172, causing the tensioning member to slide with over-center camming action along two different angles into a lever locking mode, into lever retracted position. This holds the lever in FIGS. 5 and 6 retracted positions, and against inadvertent release. Such locking mode positioning of the lever is easily, but forcibly overcome by outward manual swinging of the lever to FIG. 6 position, the connections 172 deflected outwardly by the angled doglegs 173*a* of the cam slot or slots 173, seen in FIG. 5. Conversely, as the lever is swung toward closed position, the connection or connections 172 slide out of the dogleg slots 173*a*, and into and upwardly in cam slot extents 173*b*, for lever retention. This is accommodated by the swinging, between FIG. 5 and FIG. 6 positions of the strand tensioning member 160, operatively connected to the cammed connections 172, and by the link 170 connected to the connections 172.

Note also, the lengthwise slot 180 in the part 196, allowing it to be axially adjusted, via screw adjuster 181, to tighten or loosen the strap connection to the strands 157. In FIG. 7, note the approximate alignment of the pivot locations 156, 171 and 172, with pivot location 171 having an over-center position, or proximate same.

Rotary handle 190 on 181 can be turned, relative to slider 193, at location 172, adjacent their threaded interengagement at 194 for extending or retracting a slider 195 to which part 196 is connected.

Finally, note that the lever forms a cavity into which the tensioning member is nested or received as during lever swinging.

What is claimed is:

1. An adjusting throw-off device for use on a drum having a side wall and a head, comprising in combination:

a) a support body attachable to side wall of the drum, b) a hand manipulable lever having pivotal attachment to the body, c) a tensioning member operatively connectible to a strap that tensions release strands extending adjacent the drum head, d) said member having operative guided relation with said body in tilting and in endwise extension and retraction modes, and operative connection with the lever to tension said strap and strands to captivate the lever when the lever is swung toward the support body, and to de-tension the strap and strands when the lever is swung away from the support body, e) there being a link pivotally connected to the lever and to the tensioning member, and there being a dogleg cam guide for said pivotal connection of the lever to the member.

2. The combination of claim 1 wherein:

f) said tensioning member is endwise adjustable to adjust strap and strand tension as the member is adjustably tilted, while the lever is swung over-center.

3. The combination of claim 1 wherein the member has a first portion guided for endwise sliding movement by a guide on said body, and a second portion that is link connected to the lever and in spaced relation to said pivotal attachment of the lever to said body.

4. The combination of claim 1 wherein the tensioning member and the lever have pivoted connection with the support body.

5. The combination of claim 1 wherein both the tensioning member and the lever have common pivotal connection with the support body, to tilt independently about the same axis.

6. The combination of claim 5 wherein the tensioning member has an elongated slot allowing the tensioning member to move endwise relative to said pivotal connection.

7. The combination of claim 6 wherein there is a link pivotally connected to the lever and to said tensioning member at a location that is endwise spaced from said common pivotal connection.

8. An adjusting throw-off device for use on a drum having a side wall and a head, comprising in combination:

a) a support body attachable to side wall of the drum, b) a hand manipulable lever having pivotal attachment to the body, c) a tensioning member operatively connectible to a strap that tensions release strands extending adjacent the drum head, d) said member having operative guided relation with said body in tilting and in endwise extension and retraction modes, and operative connection with the lever to tension said strap and strands to captivate the lever when the lever is swung toward the support body, and to de-tension the strap and strands when the lever is swung away from the support body, e) and wherein both the tensioning member and the lever have common pivotal connection with the support body, to tilt independently about the same axis, f) and wherein the tensioning member has an elongated slot allowing the tensioning member to move endwise relative to said pivotal connection, g) and wherein there is a link pivotally connected to the lever and to said tensioning member at a location that is endwise spaced from said common pivotal connection, h) and including a dogleg cam guide for said pivotal connection of the lever to the member.

9. The combination of claim 1 wherein the tensioning member has a threaded shank portion, there being a nut thread connected to said threaded shank portion, the nut located at a side of the lever, the nut rotatable to adjust the endwise positioning of the tensioning member.

10. The combination of claim 1 wherein the lever forms a cavity into which said tensioning member is receivable as the lever swings toward the support body.

11. The combination of claim 1 including said drum, said strap and said strands.

12. The combination of claim 11 wherein the strands consist of metal wires.

* * * * *